US006357902B1

(12) United States Patent
Horowitz

(10) Patent No.: US 6,357,902 B1
(45) Date of Patent: Mar. 19, 2002

(54) AFTER MARKET LED TAILLIGHT BULB

(76) Inventor: Brian Horowitz, 1646 Dunkirk La., Riverside, CA (US) 91720

( * ) Notice: Subject to any disclaimer, the term of this patent is extended or adjusted under 35 U.S.C. 154(b) by 0 days.

(21) Appl. No.: 09/669,007

(22) Filed: Sep. 25, 2000

(51) Int. Cl.[7] ..... F21S 8/10

(52) U.S. Cl. ..... 362/545; 362/240; 362/499; 362/545; 362/800

(58) Field of Search ..... 362/487, 499, 362/249, 240, 800, 226, 545; 439/619

(56) References Cited

U.S. PATENT DOCUMENTS

| | | | | |
|---|---|---|---|---|
| 5,707,130 A | | 1/1998 | Zwick et al. | 362/31 |
| 5,896,084 A | | 4/1999 | Weiss et al. | 340/468 |
| 5,938,320 A | | 8/1999 | Crandall | 362/494 |
| 5,947,588 A | | 9/1999 | Huang | 362/235 |
| 5,975,715 A | | 11/1999 | Bauder | 362/226 |
| 6,149,288 A | * | 11/2000 | Huang | 362/545 |
| 6,227,679 B1 | * | 5/2001 | Zhang et al. | 362/236 |

* cited by examiner

*Primary Examiner*—Sandra O'Shea
*Assistant Examiner*—John Anthony Ward
(74) *Attorney, Agent, or Firm*—Knobbe, Martens, Olson & Bear, LLP

(57) ABSTRACT

A light emitting diode (LED) assembly designed to be used in a light bulb mounting assembly in a vehicle, such as taillight or turn indicator assembly. The LED assembly having a plurality of LEDs mounted upon a single circuit board that may be arranged in numerous colors, patterns and shapes to give a distinctive look to the light generating assembly. The LED assembly is contained within a durable water and shock resistant structure with a compatible plug member to be used in conjunction with existing light bulb mounts present in the vehicle. The LED assembly can be used to easily replace existing incandescent light bulbs present in the vehicle and provide additional color and lighting patterns eliminating the need for tinted glass bulbs or light transmissive covers to generate variations in colored light.

28 Claims, 4 Drawing Sheets

AFTER MARKET LED TAILLIGHT BULB

BACKGROUND OF THE INVENTION

1. Field of the Invention

The present invention generally relates to light bulb assemblies for vehicles, and in particular, concerns taillight assembly for an automobile wherein a light emitting diode assembly is mounted within a durable water-resistant structure that is used in conjunction with existing light bulb mounts present in the automobile.

2. Description of the Related Art

Light generating sources for automobiles typically comprise an assembly wherein an incandescent light bulb is mounted within a mounting apparatus further comprising a base, which may be reflective, and a light-transmissive cover, which may be tinted to produce a particular illuminated color. Prior art light assemblies are often large and bulky in nature, especially in the case where a reflector is used to direct and intensify the light source.

Another limitation of existing incandescent light sources employing evacuated glass bulbs with tungsten filaments or higher intensity halogen-based light sources is that they typically only produce one hue of white light. As a result, in order to obtain variations in color of the light, the glass of the bulb must be tinted or a light-transmissive cover having a tint must be used. However, the appearance of the tinted covers of tail light assemblies may not be a desired appearance by all vehicle owners, particularly if the tail light assembly requires significant amounts of red material.

Further, most rear tail light assemblies on vehicles require both red warning lights and white back up lights. As the incandescent light sources provide only a single hue of white light, the tail light assembly must have both red and white tinted light transmissive covers over the light sources. This increases the overall size and cost of the tail light assembly as it requires multiple shades of light transmissive covers.

A further difficulty that occurs with existing tail light assemblies is that the assemblies can become dirty which inhibits the light transmissive properties of the cover. With the particular example of a brake light, if the light transmissive cover becomes too dirty, the cover transmit less light which makes the brake lights harder to see by oncoming vehicles. This problem is particularly exacerbated with red brake light assemblies as the red plastic comprising the cover is already dark in color and is more easily occluded.

To address this problem, most incandescent light used in brake light assemblies are high intensity lights such that the brake lights will adequately illuminate the cover even when the cover is dirty. These high intensity lights, however, have comparatively low lifespans as they are operating at such a high intensity. When the light sources burn out, the risk to the driver of the vehicle is increased as the brake light is no longer visible to oncoming traffic.

One possible solution to this problem is to use LED light sources, which illuminate in a red color and have longer lifespans. One example of an LED light source is illustrated in U.S. Pat. No. 5,947,588 to Huang. In this patent, an LED light source is positioned within a cover and is connected to an existing incandescent-style mounting location. While the LED light source in the '588 patent can illuminate the cover with red light, it is not readily adapted for use as an aftermarket replacement to existing incandescent lights in vehicle applications.

Specifically, the '588 patent discloses the LED light source being positioned within a cover such that the printed circuit board is positioned exposed within the cover space. This results in the circuitry that operates the LEDs being exposed to water and dirt that enters the space beneath the cover. One problem that occurs in the covered space in which the light bulbs are positioned is that water vapor can condense within the covered space. In the device disclosed in the '588 patent, water can thus condense on the electronic circuitry of the LED light source thereby damaging the circuitry and potentially causing the failure of the light.

Hence, there is a need for an improved light source that has longer life and produces light in a desired hue that is less affected by occlusion of the colored covers covering the light. To this end, there is a need for an LED light source that is better protected from the elements and thus able to provide light in a red hue for a longer period of time.

SUMMARY OF THE INVENTION

The aforementioned needs are satisfied by the LED assembly of the present invention which, in one aspect, comprises a replacement light assembly for a vehicle that has a circuit board having a first and a second side with a plurality of LEDs mounted on a first side of the circuit board and at least one electrical components coupled to the plurality of LEDs wherein the at least one electrical components are connected to the second side of the circuit board. The assembly further includes a housing that defines a recess wherein the circuit board is mounted within the housing such that the circuit board and the housing define an enclosed space so that the second side of the circuit board is positioned within the enclosed space separate from the LEDs themselves and is thereby more protected from the elements. In this aspect, the light assembly includes a plug member that is connected to the housing which is adapted to fit in a receptacle in the vehicle, wherein the at least one wire extends through the plug member so as to be coupled with electrical connectors positioned within the receptacle of the vehicle.

Since the electrical components of the circuit board are positioned within an enclosed space, the electrical components arc thereby more protected from exposure to the elements and, thus, the life of the light assembly is enhanced. Moreover, since the light source is an LED, a high intensity red light source is thereby provided which can provide red illumination suitable for, among other things, brake lights, without requiring the same power as ordinary incandescent lights which results in a longer lasting, brighter light. Moreover, the use of red LED lights can also permit the use of clear tinted replacement taillight assemblies instead of red tinted assemblies.

In another aspect of the present invention, the LED assembly includes a two piece housing that is coupled together via clips to retain the circuit board within an enclosed space defined by the two piece housing. The housing also advantageously connects to the plug member such that when the housing members are interconnected, the plug member is securely attached to the housing. The use of such a two-piece housing results in an inexpensive, easy to assembly housing that still affords protection to the circuitry of the LED from dust, dirt and water, but allows for quick and easy manufacturing of the assembly. These and other objects and advantages of the present invention will become more fully apparent from the following description taken in conjunction with the accompanying drawings.

DETAILED DESCRIPTION OF THE PREFERRED EMBODIMENT

Figure 1:
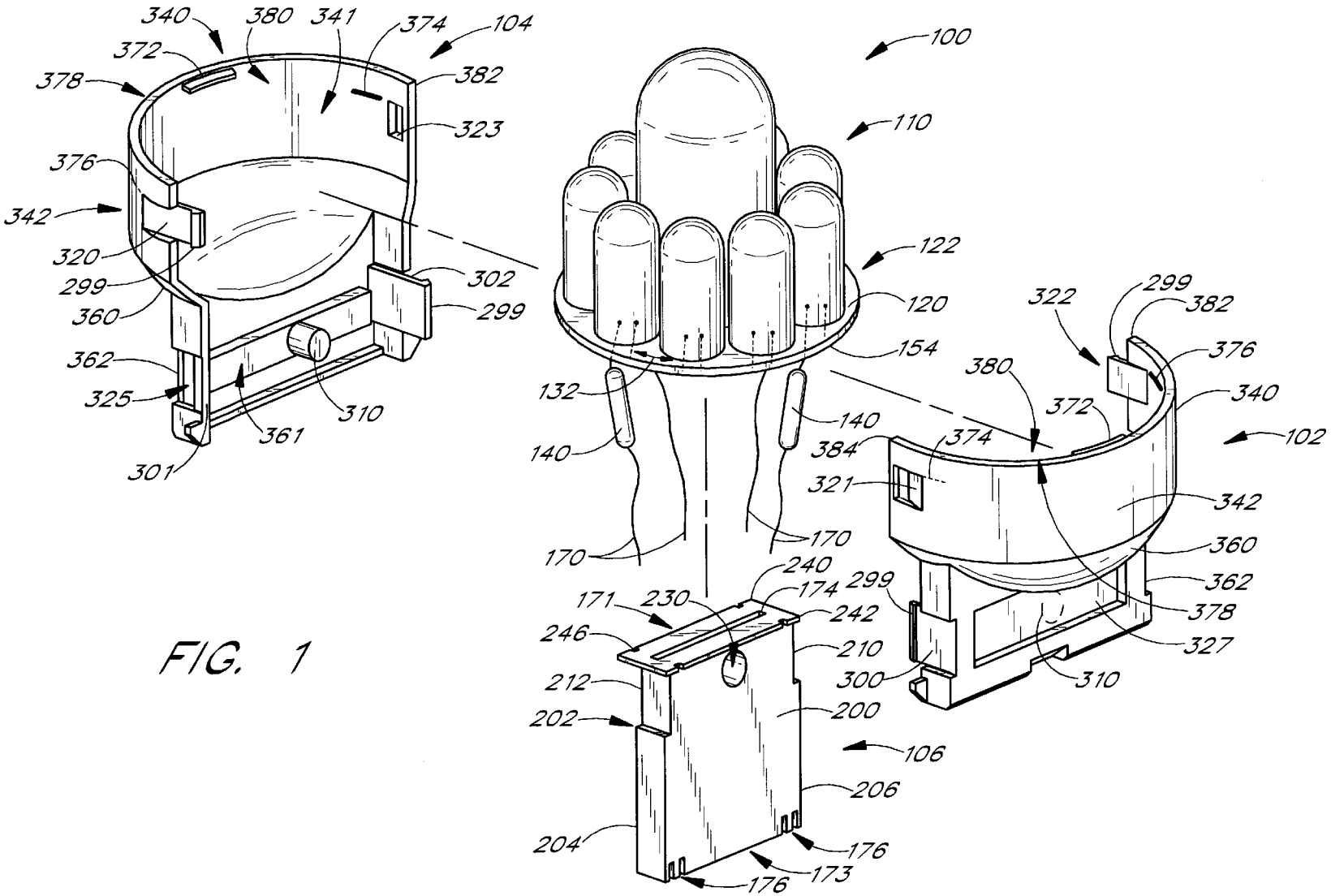
FIG. 1 is an exploded perspective view of the components of the light assembly comprising an LED assembly to be joined with a plug member using two side housing members.

Reference will now be made to the drawings wherein like numerals refer to like parts throughout. FIG. 1 illustrates an exploded view of the LED assembly 100 with left 104 and right 102 housing members and a male plug member 106. The assembled light fixture 90 (shown in FIG. 3) is adapted to be mounted by removable attachment to a female plug member (not shown) such as might be found in taillight or turn indicator assembly in a vehicle. The male plug member 106 may be adapted to join with any of a number of female plug member configurations so as to be compatible with various makes and models of vehicles. The light assembly of the present invention as such, can therefore be used to replace stock incandescent light bulbs in these vehicles by quickly and easily removing the light assembly without modifying the existing components of the female plug member or light assembly housing of the vehicle.

While a particular plug and LED configuration is shown in the illustrated embodiment it should be appreciated by those of skill in the art that many possible plug and LED combinations are possible which represent other embodiments and applications of the present invention. Thus other configurations, color combinations, or quantities of LEDs can be utilized without detracting from the spirit of the present invention. Similarly, the shape and configuration of the circuit board and housing members can be configured to other shapes and LED arrangements, for example; a rectangle, a triangle, an ellipse, a star, or other similar rounded or polygonal shape.

Referring again to FIG. 1, the LED assembly 100 in the illustrated embodiment comprises a plurality of LEDs I 10 arranged in a circular pattern. Each LED 110 is attached to a first (top) side 120 of a circuit board 122. The circuit board 122 is further configured to be circular in shape and is sized to contain the base of each LED 110 in the desired pattern. The power contacts or wires 132 for each LED 110 are attached to the circuit board 122 by crimping, soldering or suitable means, mounting the LED 110 in an upright manner substantially perpendicular to the first side 120 of the circuit board 122 with the base of each LED 110 resting flushly against the first side 120 of the circuit board 122.

The power contacts or wires 132 for each LED 110 are further passed through the circuit board 122 where they are joined to one or more electronic components 140 necessary to power and illuminate the LEDs 110 in the sequence and patterns desired. The electronics 140 which may include for example; resistors, capacitors, and wiring are located in the area directly below the bottom side 154 of the circuit board 122 and are further disposed in the recesses of the housing members 102, 104 of the completed light assembly 100 as will be discussed in greater detail hereinbelow.

A plurality of wires 170 comprising power lines to the LED assembly 100 extend from the electronic components 140 and enter a plug member 106 through an opening 174 defining a slit which extends through the body 169, top side 171 and bottom side 173 of the plug member 106. The number and arrangement of power lines 170 is based, in part, on the desired control patterns to be used with the LEDs 110 as well as any existing power contacts in the female plug member present in the automobile. In the illustrated embodiment, a series of four power lines 170 arc shown. Each power line 170 extends through the male plug member 106 and is coupled to a slit opening 176 on the bottom edge of the plug member 106. The power line 170 is positioned within the slit opening 176 and secured in position by bending, gluing, soldering or other suitable methods to provide discrete and accessible contacts points that are mated with power contacts in the female connector of the vehicle.

As previously described, the male plug member 106 is further configured to fit within a female plug member in the vehicle. In the illustrated embodiment, the plug member 106 comprises a piece of plastic, metal or other durable material, generally rectangular in shape and having front and back side 200, 202, two side walls 204, 206, and a top 171 and bottom 173 side. The width of the male plug member 106 allows it to be inserted securely into a complimentary female plug member and secured, in part, by friction generated when the male plug member sides 200, 202, 204, 206 and wiring 170 extending from the slits 176 when inserted into a compatible female plug member.

Areas along each side wall 204, 206 of the plug member 106 further define two recesses 210, 212 of similar size and depth. The recessed areas 210, 212 are configured accept latching flanges 300, 302 present on the left 102 and right 104 housing members that are passed through the recessed areas 210, 212 creating a substantially uniform edge along each side wall 204, 206 of the plug member 106 when the components comprising the right and left housing members 102, 104 and the plug member 106 are joined together as will be discussed in greater detail in subsequent figures.

The plug member 106 also has a throughgoing opening 230 that transverses the front and back sides 200, 202, adjacent to the top side 171, and equidistant from the two side walls 204, 206 of the male plug member 106. The diameter of the opening 230 is further configured to be substantially the same as the diameters of the two cylindrical pin members 310 present on the inner surfaces of each housing member 102, 104. As will be described in greater detail below, the cylindrical pin members 310 are sized so as to extend through the opening 230 so as to retain the plug member 106 within the housing defined by the two housing members 102, 104 when the housing members 102, 104 are secured together.

As is also illustrated in FIG. 1, a thin, substantially rectangular plate 240 is flushly mounted along the top side 171 of the plug member 106 wherein the plate 240 is configured to extend parallel to the top 171 and bottom 173 sides and perpendicular to the front/back sides 200, 202 and side wall 204, 206 members. The plate 240 extends slightly beyond the area defining the top side 171 of the male plug member 106 so as to create an overhang 242 along the top edge of the plug member 106. The slits 246 are positioned along the overhang 242 and aligned in parallel with the slit openings 176 in the bottom side 178 of the plug member 106 relative to the side walls 204, 206. The slits 246 each receive one power line 170 that has been passed through the male plug member 106 and bent about a slit 176 in the bottom side 178 in a manner that will be described in greater detail below.

The left 104 and right 102 housing members are comprised of plastic, metal or other durable material and joined to each other using couplers which in the illustrated embodiment comprise top 320, 322 and bottom 300, 302 latching flanges. The couplers comprising latching flanges 320, 322, 300, 302 extend from the housing member 102, 104 in a perpendicular direction to the plane created between the interface 301 between the joined housing members 102, 104 (see FIG. 3). The latching flanges 320, 322, 300, 302 are mated with flange receiving openings 321, 323, 325, 327 formed on the opposing housing member 102, 104 in the region where the latching flange 320, 322, 300, 302 of one housing member joins with the opposing housing member. An outwardly extending catch 299 formed on the ends of the latching flanges 320, 322, 300, 302 is positioned within the openings 321, 323, 325 and 327 and thereby secures the housing member sides 102, 104 together through snapwise assembly. Preferably, the flanges 320, 322, 300 and 302 are biased outward such that the extending catch 299 is biased into the openings 321, 323, 235 and 327 to thereby retain the interconnection between the flanges 320, 322, 300 and 302 and the respective openings. As will be described below, the flanges and the openings are positioned so as to engage with each other at either ends of the housing member 102, 104 so as to retain interconnection therebetween.

In the illustrated embodiment shown in the FIG. 1, the housing members 102, 104 possess a top semicircular region 340 with the sides 342 of the housing members 102, 104 further shaped to enclose a semicylindrical recess 341 of sufficient size so as to contain all of the electronic components 140 present below the bottom side 154 of the circuit board 122 when the two housing members 102, 104 are joined. The bottom 360 of the semicylindrical sides 342 further taper to join with a rectangular region 362 of the housing members 102, 104. The rectangular region 362 additionally comprises a recessed area 367 with a coupler that joins the plug member 106 to the housing member 102, 104. In the illustrated embodiment the coupler comprises a centrally disposed cylindrical protrusion comprising a plug positioning pin 310 extending into the space of the recessed area 361.

When the two housing members 102, 104 are joined the cylindrical cuplike recess 341 is formed which is contains the electronic components 140 attached to the lower side 154 of the circuit board 122. The circuit board 122 is further secured in a first position between a plurality of board positioning tabs 372, 374, 376 present along the inside perimeter of the semicylindrical sides 342 of both housing members 102, 104, As shown in the illustrated embodiment, three board positioning tabs 372, 374, 376 comprising two outer board positioning tabs 374, 376 and one central board positioning tab 372 are spaced substantially equidistant from each other along the inside wall 380 of the housing member 102, 104. The central board positioning tab 372 is situated along the top edge 378 of the housing member 102, 104 and equidistant from both ends 382, 384 of the housing member 102, 104. The two additional outer board positioning tabs 374, 376 are each positioned equidistant from the ends 383, 384 of the housing member 102, 104 and disposed below the central board positioning tab 372 at a distance substantially equivalent to the thickness of the material comprising the circuit board 122.

The plug positioning pin 310 is further disposed in the center of the rectangular region 362 of the housing member 102, 104 at a position substantially equidistant from the lower edge of the rectangular region 362 and the tapered region 360 of the housing member 102, 104. The plug positioning pin 310 is configured with similar diameter as the opening 230 in the plug member 106 with a height measuring approximately half of the width of the plug member 106.

Figure 2:
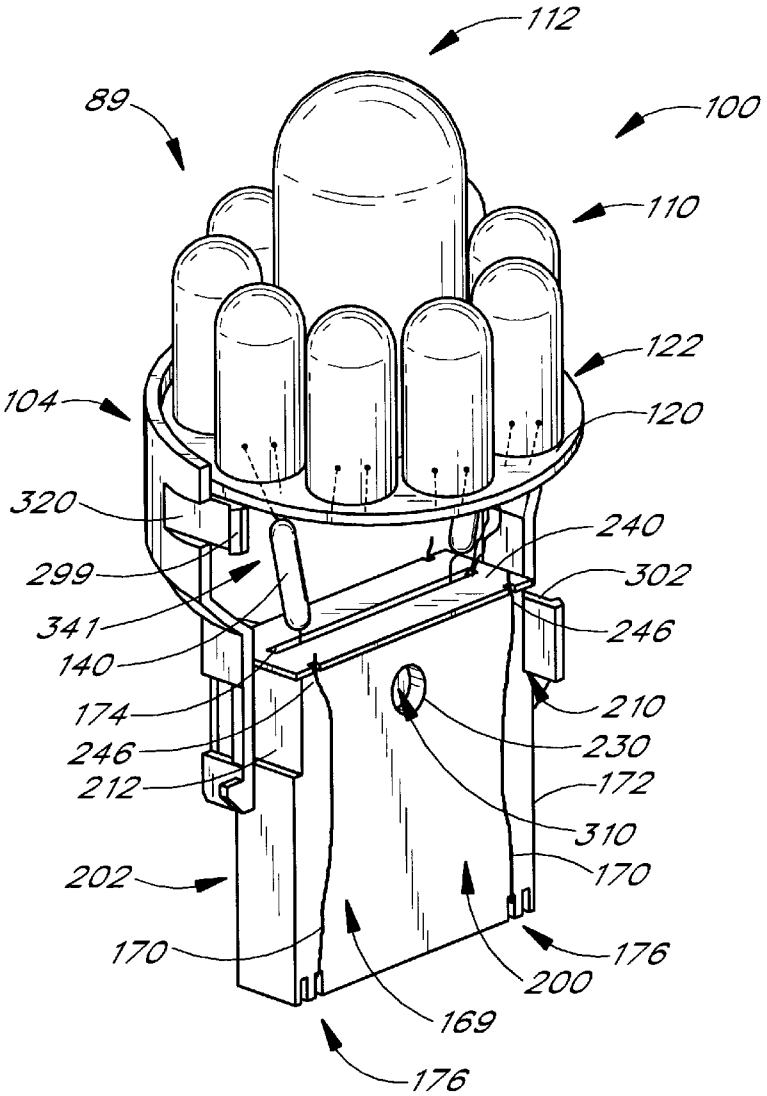
FIG. 2 is an exploded perspective view of the partially assembled light assembly of FIG. 1 wherein the LED assembly and plug member have been joined to one side housing member.

FIG. 2 illustrates a partially assembled light fixture 89 wherein the LED assembly 100 and circuit board have been positioned within the semicylindrical recess 341 of the housing member 104 between the board positioning tabs 372, 374, 376 (not visible). The housing member 104 is slidably attached to the circuit board 122 by positioning the housing member 104 with the central board positioning tab 372 above the top side 120 of the circuit board 122 and the outer board positioning tabs 374, 376 below the lower side 154 of the circuit board 122. When so positioned, the circuit board 122 may be slidably inserted into the semicylindrical recess 160 whereby the sides 342 of the housing members 102, 104 flushly fit against the contour of the edge of the circuit board 122. The board positioning tabs 372, 374, 376 further secure the circuit board 122 along a plane substantially parallel with and defined by the outer semicircular perimeter of the housing member 104. When so positioned, the LED assembly 100 extends from the housing member 104 with the circuit board 122 forming a top side enclosing the upper semicircular plane of the housing member 104.

Prior to mounting of the plug member 106 to the housing member 104, power lines 170 extending below the circuit board 122 are passed through the central slit opening 174 of the plug member 106 with each power line 170 exiting from the bottom side 173. Each power line 170 is further bent about a second slit opening 176 directing the power lines 170 towards the LED assembly 100 along the outer face of the front or back side 200, 202 of the plug member 106. The free end of each power line 170 is subsequently captured by a third slit openings 246 present on the plate 240 on the top side of the plug member 106 to secure the power line 170 in position and provide a conductive surface along the power line 170 extending from the second 176 to third slit 246 areas that will be met by contacts within the female plug member (not shown).

The plug member 106 is further attached to the housing member 102 in the rectangular recess 362 below the LED assembly 100, circuit board 122, and electronics and wiring 140 by positioning the opening 230 about the plug positioning pin 310 of the housing member 104. The recessed areas 210 of the plug member 106 are additionally captured by the latching flange 302 resulting in alignment of the plug member 106 and securing it in a flush position against the rectangular portion 362 of the housing member 104. The plug member 106 thereby partially extends from the bottom portion of the housing member 104 and is secured by the plug positioning pin 310 and latching flange 302 so as to prevent the plug member 106 from sliding in or out of the housing member 104. Additionally, sufficient room is present in the recess between the plug member 106, circuit board 122, and housing member side 342 to contain the electronic components and wiring 140 protecting them and securing them in a confined area reducing their susceptibility to water and vibrational damage.

Figure 3:
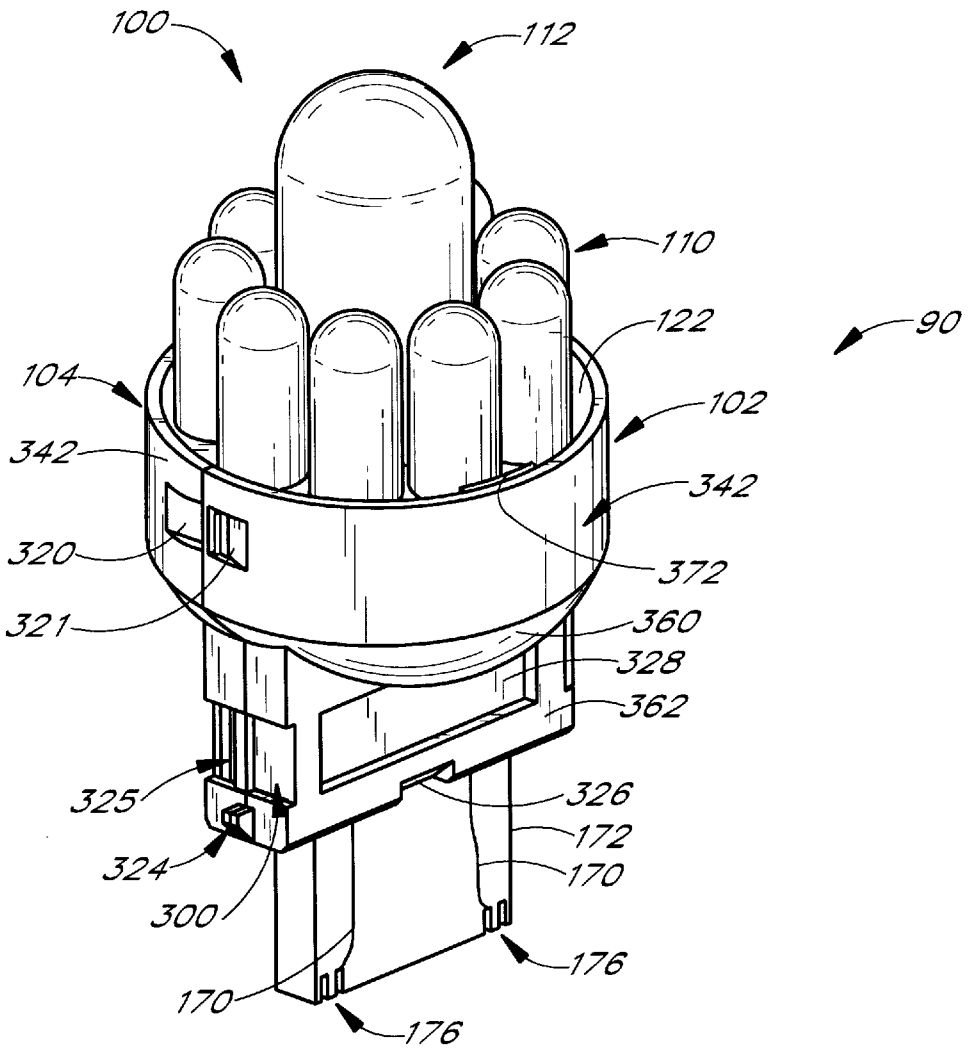
FIG. 3 is an exploded perspective view of the fully assembled light assembly of FIG. 1 wherein the LED assembly and plug member have been secured used two housing members.

The second housing member 102 is joined to the LED assembly 100, circuit board 122 and plug member 106 in a like manner as described above using the complimentary surfaces of these elements. When the two housing members 102, 104 have been positioned about the LED assembly I 00, circuit board 122 and plug member 106, the locking flanges 320, 322, 300, 302 of the housing members 102, 104 are positioned adjacent to the flange receiving areas 321, 323, 325, 327 and the resulting structure can be snapped into a completed light assembly 90 as shown in FIG. 3. The construction of the light assembly 90 can be performed easily by hand and does not require any additional tools to complete.

FIG. 3 illustrates the assembled light fixture 90 comprising the LED assembly 100 disposed above the plug member 106 and disposed between the two housing members 102, 104. Top latching flanges 320, 322 and lower latching flanges 300, 302 further join the two housing members 102, 104 together, capturing the LED assembly 100 and plug member 106 therebetween. A portion of the male plug member 106 extends below the housing members 102, 104 and conforms to the appropriate shape and size required to be mated with a female accepting plug member present in the vehicle (not shown). The power lines 170 individually positioned within the lower slit openings 176 and bent to extend into the top slit areas 246 (not visible in this illustration) of the male plug member 106, provide suitable contacts that are conductively mated with components present in the female plug member to power the LED assembly 100.

The LED assembly 100 shown in FIG. 3 extends from the housing members 102, 104 in an opposite direction from the plug member 106 with the electronic components and wiring 140 housed within the cuplike recess of the assembled light fixture 90. This assembly 90 forms a rigid and water-resistant barrier that secures the LED assembly 100 and plug member 106 in a non-moveable manner and further protects the components and wiring 140 from corrosion or vibrational damage.

Additional elements such as protrusions 324, recesses 326, and contours 328 may optionally be present along the outer surface of the light assembly 90 to conform to the structure and design of the female plug member into which the light assembly 90 is inserted. Such structures may serve as additional mounting means whereby the male plug member 106 is secured in the female plug member of the light housing of the vehicle.

Figure 4:
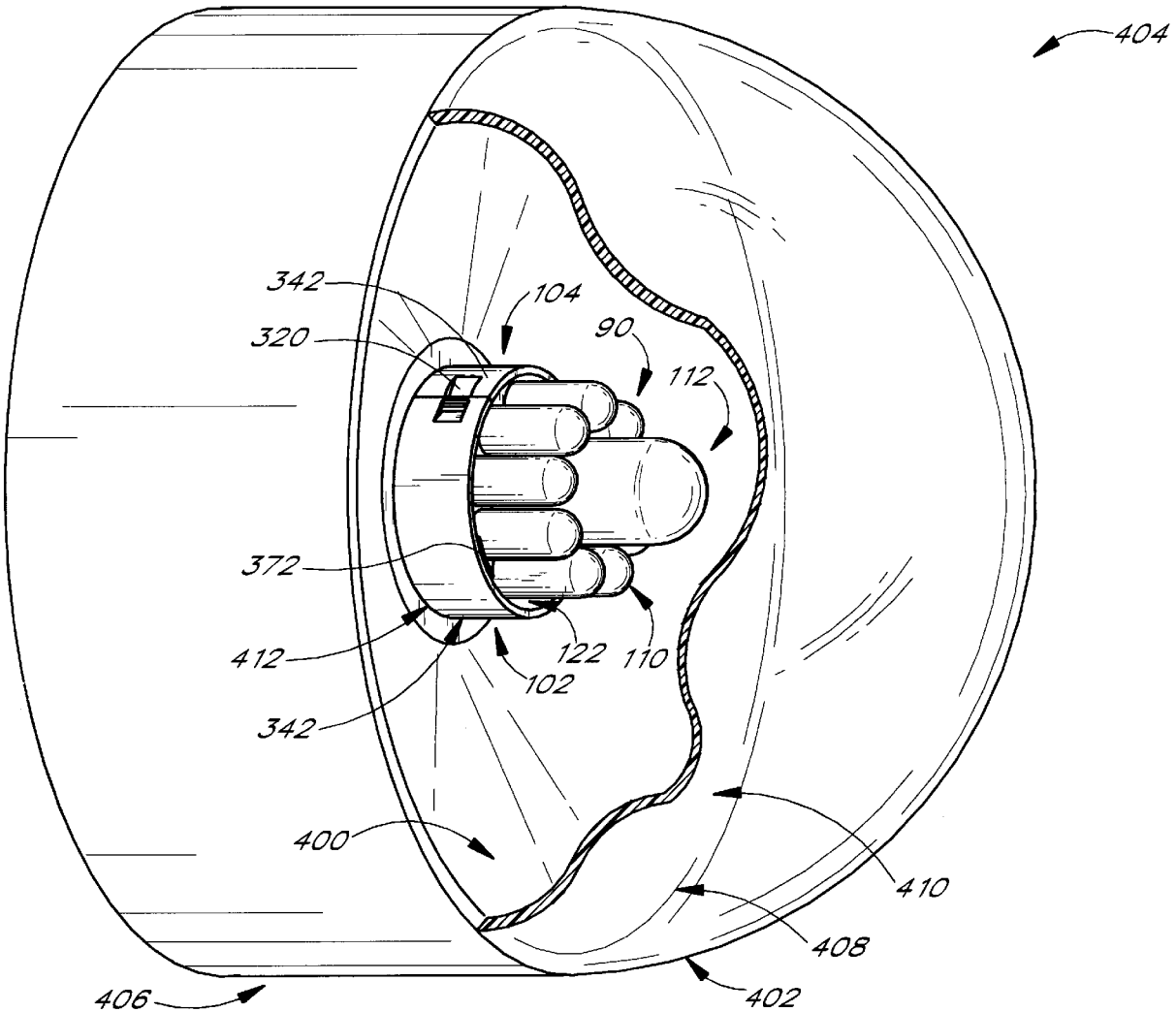
FIG. 4 is perspective view of the light assembly of FIG. 3 housed within a mounting assembly present in a vehicle comprising a light reflective member and a light transmissive lens.

An illustrated embodiment of a mounting assembly 404 housing the assembled light fixture 90 is shown in FIG. 4. The mounting assembly 404 comprises a substantially cylindrical component 406 with a proximal end enclosed by a substantially concave light reflective cover 410. The reflective cover 410 contains an area 412 defining an opening through which the male plug member 106 of the assembled light fixture 90 is inserted. The mounting assembly 404 is further configured to rest over a female plug member (not shown) wherein the male plug member 106 is joined by insertion of the assembled light fixture 90 through the area 412 of the opening in the reflective cover 410. When the plug members are joined the assembled light fixture 90 is positioned within the reflective cover 410 with the portion of the LED assembly 100 extending from the surface of the reflective cover 410. A portion of the housing members 102, 104 further extend from the reflective cover 410 so as to allow grasping of the assembled light fixture 90 about the housing members 102, 104 facilitating insertion and removal of the assembled light fixture 90. A light transmissive lens cover 402 may be additionally affixed to the mounting assembly 404 by attachment to the cylindrical component 406 in such a manner as to contain the LED assembly 100 under the lens cover 402 to provide additional protection of the components contained therein.

The mounting assembly and lens cover illustrated in FIG. 4 represents one of many possible configurations and, as such, other shapes and configurations of mounting assemblies may exist with or without a lens covers which perform similar functions and thus represent other applications of the present invention. Although the foregoing, description of the invention has shown, described and pointed out novel features of the invention, it will be understood that various omissions, substitutions, and changes in the form of the detail of the apparatus as illustrated as well as the uses thereof, may be made by those skilled in the art without departing from the spirit of the present invention. Consequently the scope of the invention should not be limited to the foregoing, discussion but should be defined by the appended claims.

What is claimed is:

1. A replacement light assembly for a vehicle having a female receptacle adapted to receive the replacement light assembly and provide electricity thereto, the assembly comprising:

a circuit board having a first and second side and an outer perimeter;

a plurality of LEDs mounted on the first side of the circuit board;

at least one electrical component coupled to the plurality of LEDs via at least one wire, wherein the at least one electrical components are connected to the second side of the circuit board;

a housing comprising a first and second housing member that are connected together so as to define a recess having interior walls wherein the circuit board is mounted within the housing such that the outer perimeter of the circuit board is positioned adjacent the inner walls of the first and second housing members so that the circuit board and the housing define a space so that the second side of the circuit board is positioned within the space; and a rectangular plug member connected to the housing that is adapted to fit in a receptacle in the vehicle wherein the plug member has a first end that is adapted to be positioned within the female receptacle and at least one exposed face positioned adjacent the first end and wherein the at least one wire extends through the plug member so as to extend out of the first end and is positioned adjacent the at least one exposed face so as to permit electrical contact to the light assembly when positioned in the female receptacle.

2. The assembly of claim 1, wherein the housing further defines a plug member recess positioned adjacent the recess that receives the circuit board wherein the plug member recess receives the plug member and retains the plug member therein when the first and second housing members are interconnected.

3. The assembly of claim 2, wherein the plug member has a coupler mounted on a first side and wherein at least one of the first and second housing members defines a coupler that engages with the coupler mounted on the first side of the plug member so as to retain the plug member in the plug member recess.

4. The assembly of claim 3, wherein the coupler mounted on the first side of the plug member comprises an opening and the coupler on at least one of the first and second housing members defines a protrusion that extends into the opening so as to retain the plug member in the plug member recess.

5. The assembly of claim 1, wherein the first and second housing members define positioning tabs in the recess so that the circuit board is retained in the recess by the positioning tabs.

6. The assembly of claim 1, comprising interconnecting couplers mounted on the first and second housing members so that the first and second housing members can be connected together.

7. The assembly of claim 6, wherein the interconnecting couplers comprise locking tabs and openings formed on the first and second housing members to permit secure engagement therebetween.

8. The assembly of claim 6, wherein the interconnecting couplers and the couplers connecting the plug member to the housing comprise snap connections such that the assembly can be fully assembled without the use of tools.

9. The assembly of claim 1, wherein the assembly further comprise a mounting structure with a light transmissive cover lens.

10. The assembly of claim 1, wherein the space is an enclosed space.

11. A replacement light assembly for a vehicle having a light receptacle, the assembly comprising:

a circuit board having a first and a second side and an outer perimeter;

a plurality of LEDs mounted on the first side of the circuit board;

at least one electrical components coupled to the plurality of LEDs via at least one wire, wherein the at least one electrical components are connected to the second side of the circuit board;

a plug member coupled to at least one electrical component by at least one wire, wherein the plug member has a first end that is adapted to be positioned within the light receptacle; and a housing comprised of a first and a second matching housing member that are interconnected together so as to denied a first recess and a second recess wherein the first and the second recess each has interior walls, wherein the circuit board is mounted in the first recess so as to be more protected wherein the outer perimeter of the circuit board is positioned adjacent the inner walls of the fist recess, and the plug member is mounted in the second recess so as to extend therefrom to permit electrical connection from the vehicle light receptacle to the plurality of LEDs via the plug member.

12. The assembly of claim 11, wherein the housing further defines positioning tabs which retain the circuit board in the first recess.

13. The assembly of claim 11, wherein the housing further defines a positioning pin about which the plug member is mounted to retain it in the second recess.

14. The assembly of claim 11, wherein the electrical components are retained in the enclosed space of the housing member so as to be protected from damage.

15. The assembly of claim 11, further comprising interconnecting couplers mounted on the first and second housing members so that the first and second housing members can be connected together.

16. The assembly of claim 15, wherein the interconnecting couplers comprise locking flanges that are slidably attached to flange receiving areas present on the opposing housing member.

17. The assembly of claim 15, wherein the first and second housing members are connected together by snapable connections such that the assembly can be fully assembled without the use of tools.

18. The assembly of claim 11, wherein the circuit board is mounted in the first recess so as to be protected from water.

19. The assembly of claim 11, wherein the plug member has at least one exposed face positioned adjacent to the first end and wherein the at least one wire extends through the plug member so as to extend out of the first end and is positioned adjacent the at least exposed face so as to permit electrical contact to the light assembly when positioned in the light receptacle.

20. A replacement light assembly for a vehicle, the assembly comprising:

a circuit board having a first and second side;

a plurality of LBDs mounted on the first side of the circuit board;

at least one electrical components coupled to the plurality of LEDs via at least one wire, wherein the at least one electrical components are connected to the second side of the circuit board;

a housing comprising a first and second housing member that are connected together so as to define a recess having inner walls wherein the circuit board is mounted within the housing in a manner such that the inner walls of the recess flushly fit against the contour of an edge of the circuit board wherein the circuit board forms a top side enclosing an upper plane of the housing wherein the LEDs extend from the upper plane of the housing;

a plug member connected to the housing that is adapted to fit in a receptacle in the vehicle wherein the at least one wire extends through the plug member so as to be coupled with electrical connectors positioned within the receptacle.

21. The assembly of claim 20 wherein the housing further defines a plug member recess positioned adjacent the recess that receives the circuit board wherein the plug member recess receives the plug member and retains the plug member therein when the first and second housing members are interconnected.

22. The assembly of claim 21, wherein the plug member has a coupler mounted on a first side and wherein at least one of the first and second housing members defines a coupler that engages with the coupler mounted on the first side of the plug member so as to retain the plug member in the plug member recess.

23. The assembly of claim 22, wherein the coupler mounted on the first side of the plug member comprises an opening and the coupler one at least one of the first and second housing members defines a protrusion that extends into the opening so as to retain the plug member in the plug member recess.

24. The assembly of claim 20, wherein the first and second housing members define positioning tabs in the recess so that the circuit board is retained in the recess by the positioning tabs.

25. The assembly of claim 19, further comprising interconnecting couplers mounted on the first and second housing members so that the first and second housing members can be connected together.

26. The assembly of claim 25, wherein the interconnecting couplers comprise locking tabs and openings formed on the first and second housing members to permit secure engagement therebetween.

27. The assembly of claims 23, wherein the interconnecting couplers and the couplers connecting the plug member to the housing comprise snap connections such that the assembly can be filly assembled without the use of tools.

28. The assembly of claim 20, wherein the assembly further comprise a mounting structure with a light transmissive cover lens.

* * * * *

UNITED STATES PATENT AND TRADEMARK OFFICE

CERTIFICATE OF CORRECTION

PATENT NO. : 6,357,902 B1
DATED : March 19, 2002
INVENTOR(S) : Brian Horowitz

It is certified that error appears in the above-identified patent and that said Letters Patent is hereby corrected as shown below:

Column 9,
Line 14, please delete “denied” and add -- define --.

Column 10,
Line 34, please delete “one at” and add -- on at --.

Signed and Sealed this

Eleventh Day of March, 2003

JAMES E. ROGAN
*Director of the United States Patent and Trademark Office*